US007785083B2

(12) United States Patent
Mamei et al.

(10) Patent No.: US 7,785,083 B2
(45) Date of Patent: Aug. 31, 2010

(54) DYNAMIC FLUID DEVICE

(75) Inventors: Eronne Mamei, Modena (IT); Omer Mamei, Modena (IT); Enrico Mamei, Modena (IT)

(73) Assignee: Studio Tecnico 6M S.R.L., Modena (IT)

( * ) Notice: Subject to any disclaimer, the term of this patent is extended or adjusted under 35 U.S.C. 154(b) by 777 days.

(21) Appl. No.: 11/585,629

(22) Filed: Oct. 24, 2006

(65) Prior Publication Data

US 2007/0048146 A1 Mar. 1, 2007

(51) Int. Cl.
*F04B 23/04* (2006.01)

(52) U.S. Cl. ..... 417/427; 417/213; 417/216; 60/421; 91/516

(58) Field of Classification Search ..... 417/427, 417/213, 216, 250; 137/565.29, 625.48; 60/421, 430; 91/514, 516
See application file for complete search history.

(56) References Cited

U.S. PATENT DOCUMENTS 4,002,027 A * 1/1977 Eley et al. ..... 60/430
5,765,594 A * 6/1998 Collins et al. ..... 137/625.48
6,205,780 B1 * 3/2001 Zervas ..... 60/421
7,204,186 B2 * 4/2007 Mamei et al. ..... 91/516

FOREIGN PATENT DOCUMENTS

DE 38 23 892 1/1990
DE 3823892 A1 * 1/1990

* cited by examiner

*Primary Examiner*—Devon C Kramer
*Assistant Examiner*—Todd D Jacobs
(74) *Attorney, Agent, or Firm*—Collard & Roe, P.C.

(57) ABSTRACT

The dynamic fluid device has a first pumping arrangement and second pumping arrangement arranged in parallel with each other to pump a pressurized fluid to user devices; at least a distributor member interposed amongst the first pumping arrangement, second pumping arrangement and the user devices and connected to them with connection arrangements, the at least a distributor member being arranged to connect singly and/or jointly and/or according to predetermined sequences, the first pumping arrangement and/or the second pumping arrangement to the user devices.

12 Claims, 6 Drawing Sheets

DYNAMIC FLUID DEVICE

BACKGROUND OF THE INVENTION

The present invention refers to a dynamic fluid device.

Use of hydraulic pumps with a fixed flow rate to feed user device of the same machine is well known and, in order for each one of them to work, they require a predefined flow of pressurised fluid which is oil in this specific case.

Hydraulic pumps with a fixed flow rate have the advantage of being considerably more economical than those with a variable flow rate which are also known and widely used.

One example of where these pumps are installed is on agricultural machines: they have hydraulic systems that feed main and secondary functions.

By the term main functions it is understood those functions the machine needs to move safely, for example, hydraulic powered steering, while by the term secondary functions it is understood those operating functions machines can be equipped with for working, for example, a hydraulic lifting equipment, a bucket and the like.

To feed all the user devices, the pumps with a fixed flow rate must be sized to guarantee a sufficient flow of pressurised oil under the heaviest conditions, i.e. when a great number of the primary and secondary devices are being used simultaneously.

When this does not occur, i.e. when only one user device is used, the pump, sized to supply a flow to meet the heaviest conditions, continues to supply the same flow of pressurised oil which becomes noticeably much more than what is really needed to operate a single user device; consequently, a large part of the pressurised oil flow supplied by the pump is superfluous and, for this reason, sent to a discharge point of the hydraulic system provided for.

This situation leads to a useless consumption of energy to be supplied to the pump for it to work and an anomalous heating of the pressurised oil, due to the fact it is not all used.

To solve these drawbacks, hydraulic circuits are used equipped with two pumps with a predefined fixed flow rate and arranged in parallel with each other; each pump is connected by a pipe to a single first user device and a single second user device.

An extension of the feed pipes is provided for at the output of both the first and second user devices that join together to flow into one single additional pipe which, in turn, is connected to a third user device; the sum of the flows of the single pumps when they are both working comes together in this one single additional pipe.

Nevertheless, a solenoid valve is mounted on one of the feed pipe extensions, before they join together, which opens or closes the extension it is mounted on, alternatively letting the flow of oil go through this extension to the third user device together with the flow of oil that goes through the parallel pipe of the other user means, or deviating the flow of the pipe extension on which it is mounted to a discharge way contemplated for this purpose in the hydraulic circuit.

In this way three user devices can be supplied with three different flows and the total value of the flow rates can be regulated with greater precision in line with the requirements of the user device being used, turning the pumps on or off as needed.

With this adjustment it is allowed to reduce the flow of pressurised oil to be discharged if all or part of it is not being used by one or more user devices.

A second known hydraulic system to supply user devices uses just one pump, normally a gear pump which, by means of a pipe, is connected to a distributor unit arranged to distribute pressurised oil "on demand" to a multitude of user devices.

The oil is distributed "on demand" in order to work one or more user devices and the request for oil is activated either by a manual operation of a user devices' driving unit mounted on a machine by an operator or by an automatic device arranged for this purpose on the distributor.

A valve is installed between the gear pump and distributor that connects the oil feeding pipe, adjusting the passage hole through which the oil flows to a discharge way.

The valve is controlled by pressure signals that reach it by way of a pressure detecting pipe which in technical jargon is called a "load-sensing line"; pressure is detected inside the distributor and transmitted to the valve which, according to the specific requirements of pressurised oil modifies the passage hole to the distributor and, hence, the available flow of pressurised oil to the user devices; when no signal is sent by the load-sensing line, the valve normally keeps the feed pipe connected to the discharge way and all the pump flow goes into it.

An additional requirement of agricultural machines and work vehicles in general that are fitted with a multitude of hydraulically controlled user devices, is that the feeding must be provided by the pumps according to an established priority, where the user devices that controls the machines main functions are supplied first followed by the user devices that control the secondary functions.

The state of the art described previously has a few drawbacks.

A first drawback is that the hydraulic circuits that have pumps with a fixed flow rate feeding single user device do not allow for priority in feeding such devices.

A second drawback is that if, in a hydraulic circuit which has two pumps in parallel with each other, one of the pumps is damaged, the user device being supplied by this damaged pump cannot work.

A third drawback is that if a third user device requires a reduced flow of pressurised oil to work compared to the flow rate just one of the pumps installed in parallel on the hydraulic circuit can supply, a significant quantity of pressurised oil has to be discharged and the energy spent to operate the pump, or both pumps, is lost.

SUMMARY OF THE INVENTION

The technical aim of the invention is to improve the state of the art.

One object of the invention is to make a dynamic fluid device allowing to limit the losses of energy spent to feed pressurised oil to the work vehicle user means that require low oil rates of flow.

Another object of the invention is to make a dynamic fluid device allowing to feed work vehicle user devices according to a predetermined priority.

Yet another object of the invention is to make a dynamic fluid device allowing to feed work vehicle user devices also when one of the pumps that supplies parallel flows of pressurised oil shuts down due to a failure.

Another object of the invention is to make a dynamic fluid device that can be installed on already existing hydraulic circuits and used on work vehicles.

According to one aspect of the invention a dynamic fluid device is contemplated comprising: a first pumping arrangement and a second arrangement arranged in parallel with each other to pump a pressurised fluid to user devices; a distributor member interposed amongst said first pumping arrangement, second pumping arrangement and said user devices and connected to them with connection arrangements, wherein said distributor member is arranged to connect singly and/or jointly and/or according to predetermined sequences, said first pumping arrangement and/or said second pumping arrangement to said user devices.

According to another aspect of the invention a dynamic fluid device is contemplated comprising: first pumping arrangement and second pumping arrangement arranged in parallel with each other to pump a pressurised fluid to user devices having respective feeding priorities; a distributor member interposed amongst said first pumping arrangement, second pumping arrangement and said user devices and connected to them with connection arrangements, wherein said distributor member is arranged to connect singly and/or jointly and/or according to predetermined sequences, said first pumping arrangement and said second pumping arrangement to said user devices complying with said respective feeding priorities.

The dynamic fluid device does, therefore, allow to send predefined rates of flow of pressurised oil to machine user devices according to pre-established requests and also according to pre-established priorities, thus noticeably reducing the amount of energy lost to operate the sources that supply machine user devices with pressurised oil.

BRIEF DESCRIPTION OF THE DRAWINGS

Further characteristics and advantages of the present invention will appear even more evident from the description of a form of embodiment of a dynamic fluid device illustrated by way of non limiting example in the accompanying drawings, wherein.

DETAILED DESCRIPTION

Figure 1:
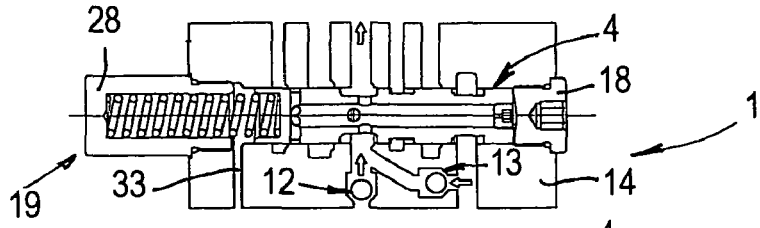
FIG. 1 is a longitudinal section view of a first version of a dynamic fluid device in a configuration where only one of three user devices is fed with pressurised oil supplied at full rate by a first and a second pump arranged in parallel with each other.

With reference to the Figures, 1 indicates a dynamic fluid device as a whole which comprises first pumping arrangement 2 and second pumping arrangement 3 arranged in parallel with each other to pump a pressurised fluid—which is oil in this specific case—to three user points or user devices that are operable with pressurised oil and which are schematically indicated in the figures with "PR1", "PR2" and "EF" respectively, and more specifically, with "PR1" is indicated a first user device, with "PR2" the second user device and with "EF" the third user device.

The dynamic fluid device 1 also comprises distributor member 4 that is interposed amongst said first pumping arrangement 2, second pumping arrangement 3 and user devices "PR1", "PR2" and "EF" and connected to them with connection arrangements, for example, annular-shaped connection holes, a first hole 5, fifth hole 6, a sixth hole 7 respectively.

The first pumping arrangement 2 and the second pumping arrangement 3 each comprise their own first pump 8 and second pump 9, both with a fixed flow rate that, through the respective first connection hole 5 and second connection hole 11, controlled by respective one-way valves 12 and 13, send pressurised oil to the distributor member 4.

The latter comprise a body 14 in which at least one sliding chamber 15 is made and into which the connection holes 5, 6, 7 and 11 flow; besides these, a third connection hole 16 and a fourth connection hole 17 are contemplated that connect the sliding chamber 15 with, respectively, two discharge ways indicated in the drawings by arrows "S1" and "S2".

The sliding chamber 15 is cylindrically shaped and features a first end 115 closed with a plug 18 and an opposing second end 215 closed with contrast member 19 described more in detail further on.

The distributor member 4 also comprises a distributor element 20 slidingly accommodated in the sliding chamber 15 and which is arranged, sliding inside it, to open and shut all the connection holes 5, 6, 7, 11, 16, 17 according to a predetermined sequence; slides of the distributor element 20 occurs by overcoming the action of the contrast member 19.

The distributor element 20 comprises a cylindrical body 21 axially crossed by a through conduit 22; this has a third open end 122 that faces the plug 18 and an opposing fourth end 222 that features first crosswise openings 23 flowing into the sliding chamber 15 and which are obtained in the cylindrical body 21; the through conduit 22 also has second crosswise openings 24 flowing into the sliding chamber 15 which are obtained in the cylindrical body 21 in a position between the first crosswise openings 23 and the third end 122, substantially by the first hole 5.

The first user device "PR1" is connected to the first pump 8 and also to the second pump 9 by means of an intermediate conduit 111 obtained inside the body 14 and which connects the second pump 9 to the first pump 8.

Peripherally, the cylindrical body 21 features at least three perimeter grooves created in succession: a first groove 25 is arranged to connect, by means of the sliding of the cylindrical body 21, the second connection hole 11 and the fourth connection hole 17 together, a second groove 26 is arranged to connect, between the first connection hole 5 and the third connection hole 16, a third groove 27 is provided to connect the first hole 5 and the sixth hole 7 together.

The second crosswise holes 24 open into the third groove 27 while the first crosswise holes 23 are provided to connect, according the slidings of the cylindrical body 21, the through conduit 22 with the fifth annular-shaped hole 6.

The contrast member 19 comprises a plug element 28 that can be screwed into the second end 215 of the sliding chamber 15.

A first housing 29 is defined inside the plug element 28, created axially and inside which a return spring 30 is housed, contained between the bottom 129 of the first housing 29 and the opposing second concave housing 31 obtained in the fourth end 222.

A detecting line L between the sliding chamber 15 and the user devices "PR1", "PR2" and "EF" detects the pressure inside the latter, known by the term "load-sensing line", by means of which a signal indicated with "LS" flows into the sliding chamber 15 through a connecting conduit 33 created in the body 14.

Figure 9:
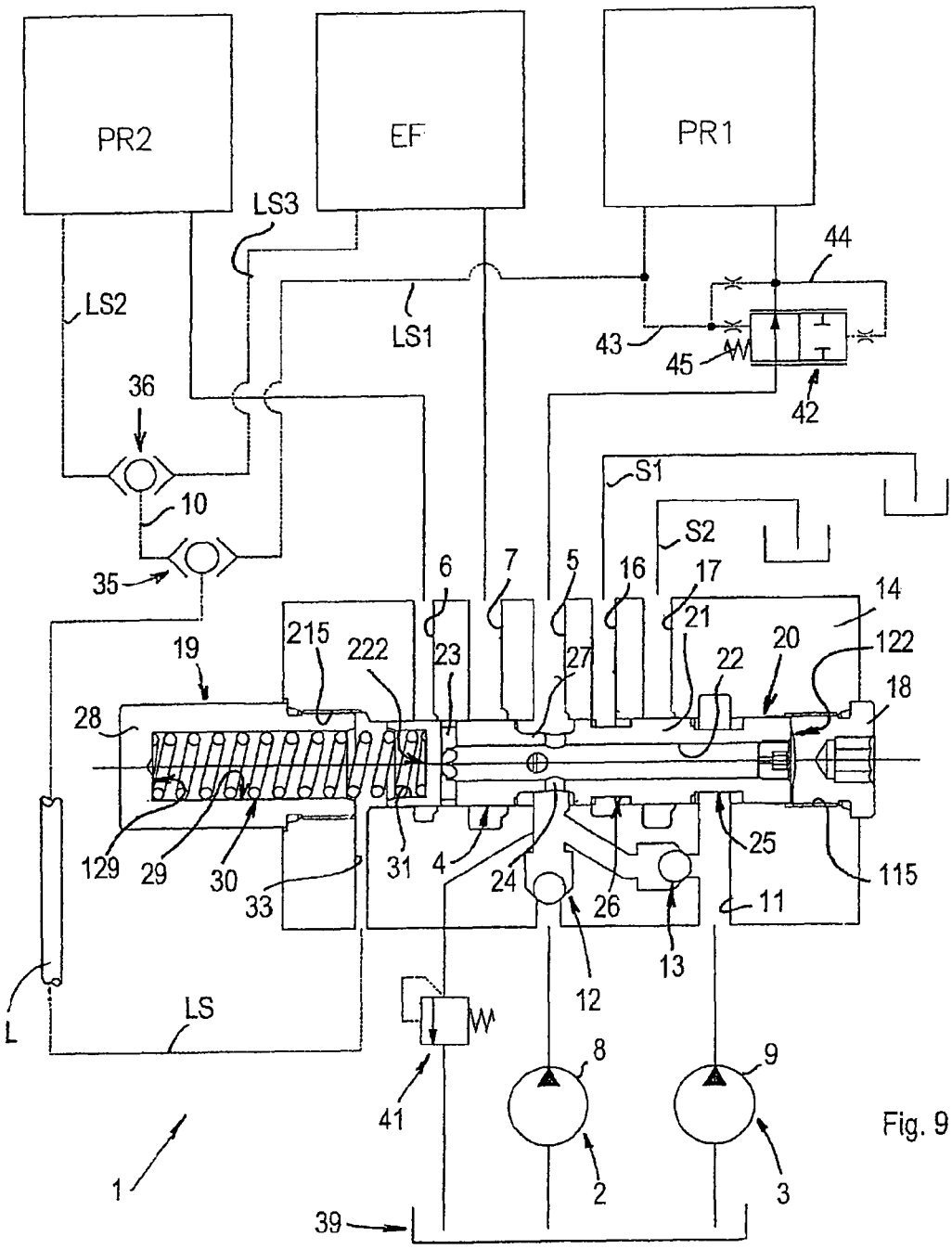
FIG. 9 is a diagram of the dynamic fluid device in the configuration of FIG. 1.
Figure 10:
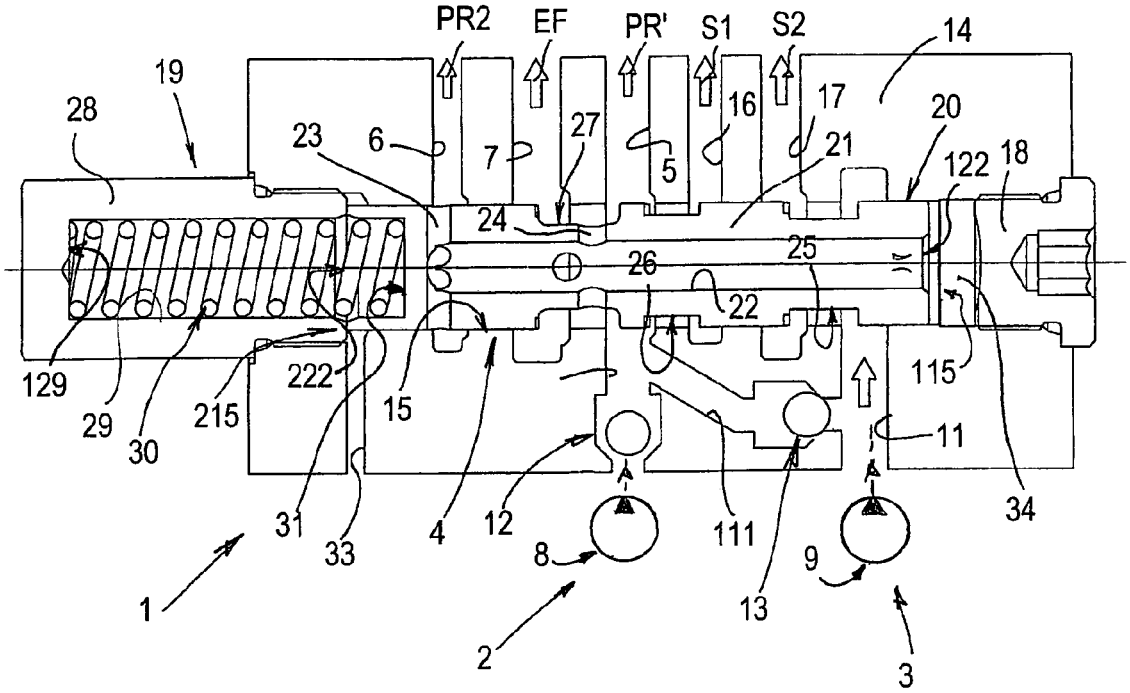
FIG. 10 shows a longitudinal section view, on an enlarged scale, of the dynamic fluid device of FIG. 8.
Figure 11:
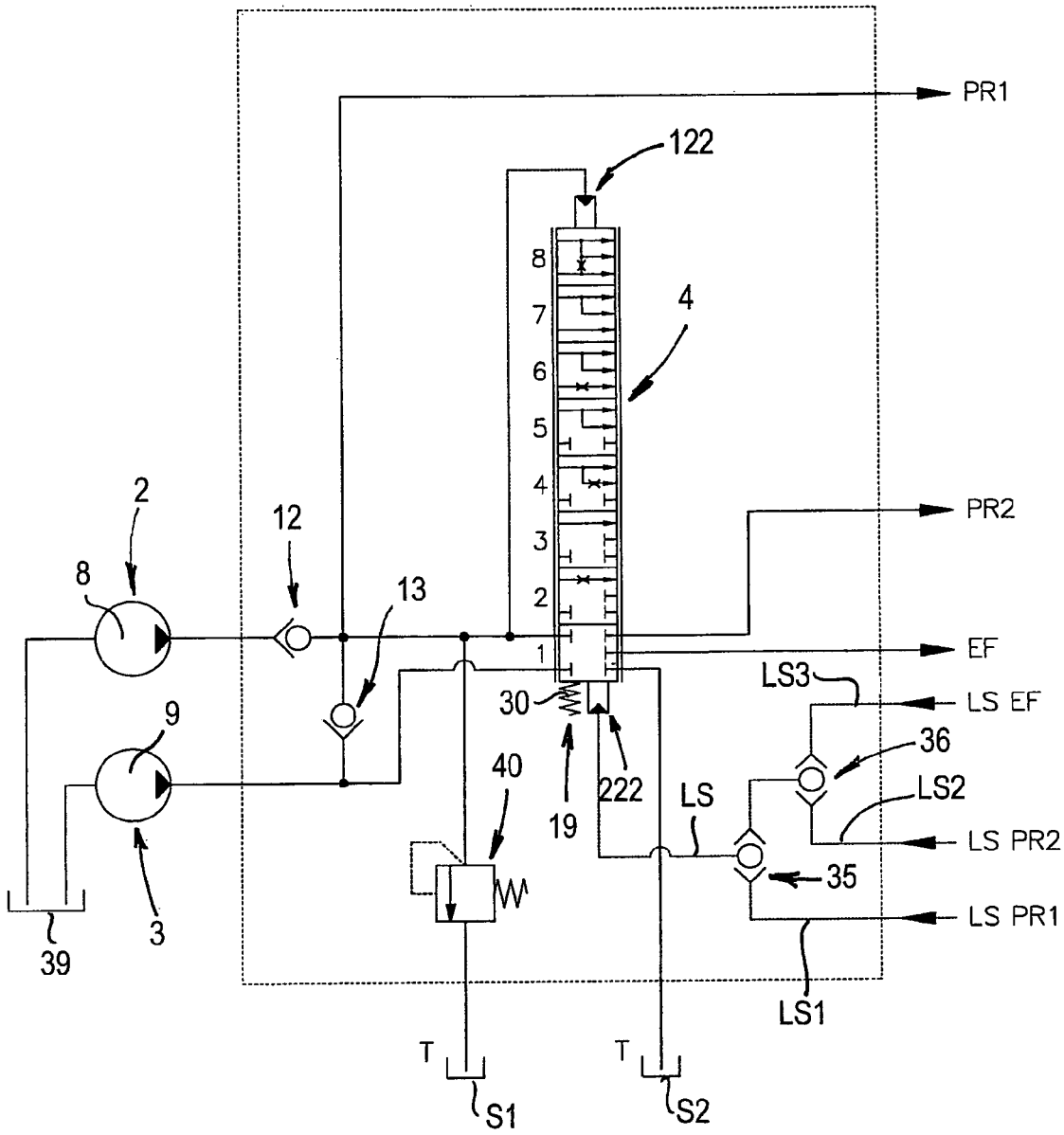
FIG. 11 is a hydraulic diagram of the dynamic fluid device in the FIG. 1 configuration where an over-pressure safety relief valve has been added connected to a distributor member.
Figure 12:
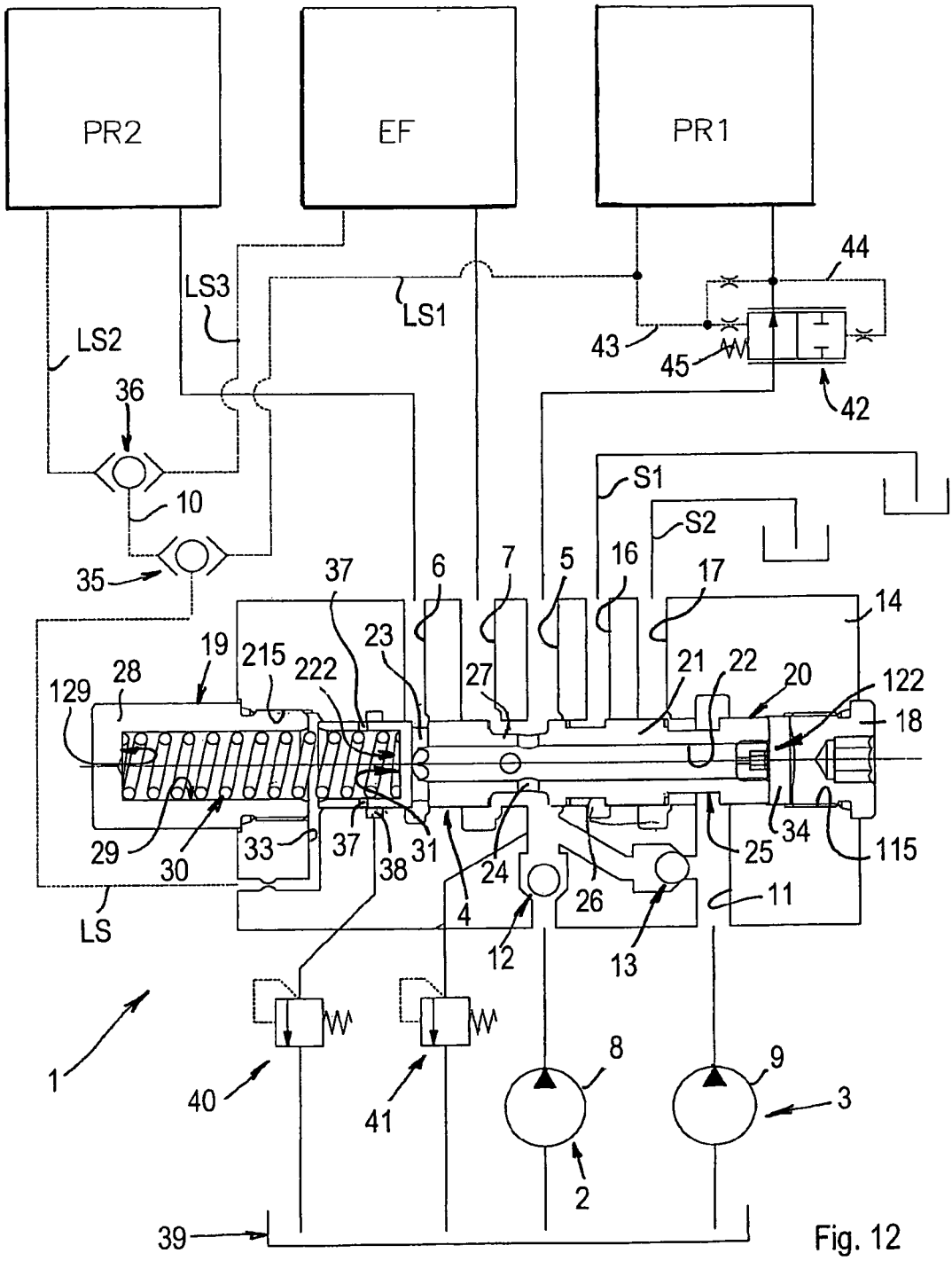
FIG. 12 a longitudinal section view of a second version of the dynamic fluid device of FIG. 7 to which third valve apparatus have been added.

With reference to FIGS. 9 and 12, it can be seen that the load-sensing signal "LS" corresponds to the strongest of the "LS1", "LS2", and "LS3" signals because all the load-sensing signals "LS1", "LS2", "LS3" go towards the first valve apparatus 35 and second valve apparatus 36: more precisely, the load-sensing signals "LS2" and "LS3" reach the second valve apparatus 36 coming from the second user device "PR2" and third user device "EF", the strongest of which goes through the second valve apparatus 36, closing passage to the other signal and, through a line 10, flows to the first valve apparatus 35 where the load-sensing signal "LS1" also flows, coming from the first user device "PR1".

Also in this case, the strongest signal goes through the first valve apparatus 35 which consequently close passage to the other signal.

The resulting "LS" signal reaches the first housing 29 through the connecting conduit 33 and acts jointly with the spring 30 on the surface of the second concave housing 31.

Figure 13:
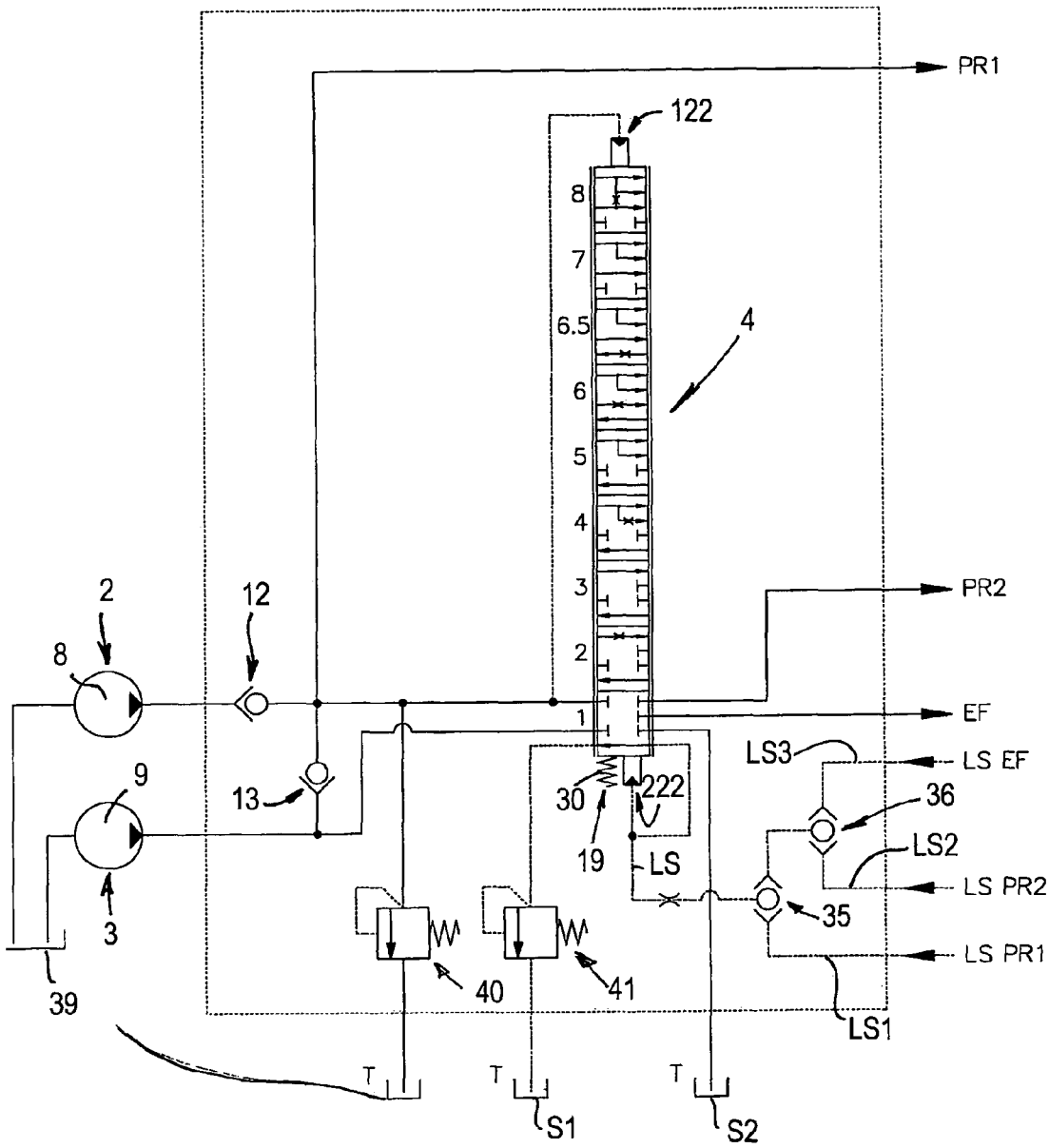
FIG. 13 is a hydraulic diagram of the second version of the dynamic fluid device of FIG. 12.

According to a second version of the dynamic fluid device 1 illustrated in FIGS. 12 and 13, a radial opening 37 is made in the second concave housing 31 which, when the cylindrical body 21 slides along, opens or closes, aligning itself with a seventh annular-shaped hole 38 which, in this second version, is created in the body 14, between the connecting conduit 33 and the fifth hole 6.

The seventh annular-shaped hole 38 is connected to a storage or drainage tank 39 with the interposition of third valve apparatus 40 that are normally closed, and opened when the pressure inside the annular-shaped hole 38 reaches an established limit value: more specifically, the third valve apparatus 40 acts as a so called "over-pressure safety relief valve".

Additional fourth valve apparatus 41 comprising another "over-pressure safety relief valve", completely identical to the previous one, is interposed between the tank 39 and the first hole 5 and also these fourth valve apparatus 41 are normally closed and opened when the pressure inside the first hole 5 reaches a predetermined limit value.

Fifth valve apparatus 42 are also contemplated between the first hole 5 and the first user device "PR1", and are normally open, as can be seen in FIGS. 19 and 12; these fifth valve apparatus 42 is provided to protect the first user device "PR1" against excessive pressure values, closing the passage of oil towards it.

The operation of the dynamic fluid device is explained below with reference to the various positions of the cylindrical body 21 illustrated in FIGS. 8 to 1.

Figure 8:
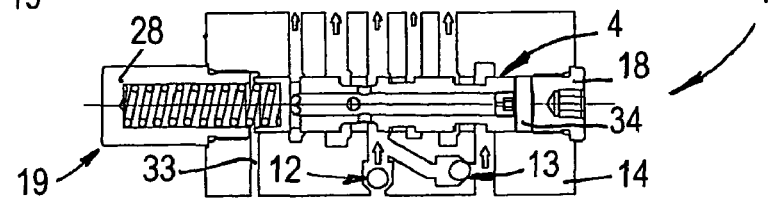
FIG. 8 is the longitudinal section view of FIG. 7 in a configuration where the three user devices are fed with pressurised oil supplied at partial rate only by the first pump.

FIG. 8 illustrates the configuration that occurs when a motor is turned on that operates the first pump 8 and the second pump 9 and when none of the user device "PR1", that could coincide for example with the steering device of a vehicle, "PR2", that could correspond to the braking system of a vehicle, and "EF", that could correspond to a working tool of a vehicle, require a flow of oil.

Consequently, the cylindrical body 21 remains balanced inside the sliding chamber 15 between the force exerted by the contrast member 19 and the pressure of the oil that is taking up the space 34 and which is pushing against the third end 122 of the body 21; with the body 21 in this position the second pump 9 is connected to the discharge way "S2" through the first groove 25, and it's just the first pump 8 that sends oil to the user devices "PR1£, "PR2" and "EF" through the second crosswise openings 24, the through conduit 22, the first crosswise holes 23, with a partial flow rate, because it is also connected partially to the discharge way "S1" through the second groove 26 which, in this configuration, is located across the first hole 5 and the third hole 16.

When an user device requires a bigger flow of oil, that is, when a person operates one or more of the user devices "PR1", "PR2" and "EF", a "load-sensing" signal "LS" is generated which, through the connecting conduit 33, reaches the first housing 29 and acts by pressing on the second concave housing 31, summing its own force with that of the spring 30.

In the eventuality more than one user device is activated simultaneously, the "LS" signal that acts on the second concave housing 31 coincides with the strongest of the "LS1", "LS2" and "LS3" signals that pass through the second valve apparatus 36 and the first valve apparatus 35.

Figure 7:
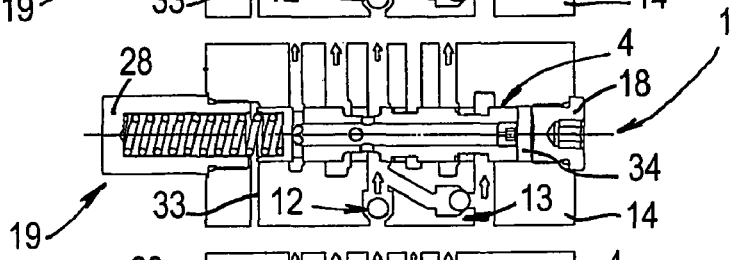
FIG. 7 is the longitudinal section view of FIG. 6 where the three user devices are fed with pressurised oil supplied at full rate only by the first pump.

This pressure makes the cylindrical body 21 move towards the plug 18, gradually reaching the configuration illustrated in FIG. 7.

In this configuration, the whole flow rate of the first pump 8 is sent to the user devices "PR1", "PR2" and "EF" because the passage between the second groove 26 and the third hole 16, which is in connection with the discharge way "S1", has closed.

Figure 6:
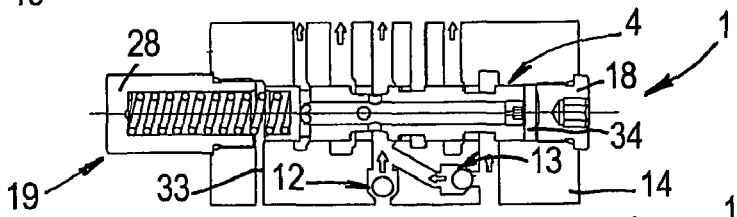
FIG. 6 is the longitudinal section view of FIG. 5 where the three user devices are fed with pressurised oil supplied at full rate by the first pump and at partial rate by the second pump.

If the flow rate of oil is not sufficient to feed the user devices "PR1", "PR2" and "EF", the "load-sensing" signal continues to act on the concave housing 31, still moving the cylindrical body 21 in the direction of the plug 18 and gradually reaching the configuration illustrated in FIG. 6.

In this configuration, the connection between the first groove 25 and the fourth hole 17 is reduced, the pump 9 builds up pressure, the one-way valve 13 starts to open and the second pump 9 also starts sending a flow of oil, even though it is partial, to the user devices "PR1", "PR2" and "EF" in parallel with the first pump 8 through the intermediate conduit 111, while another part of the oil flow is still sent to the discharge way "S2".

Figure 5:
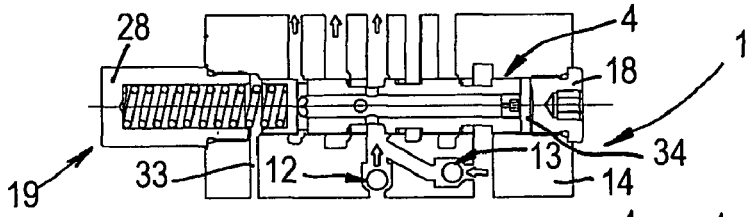
FIG. 5 is the longitudinal section view of FIG. 4 where three user devices are fed with pressurised oil supplied at full rate by both the first and second pump.

If the flow of oil is still not enough to meet the requirements of the user devices "PR1", "PR2" and "EF", the "load-sensing" signal continues acting on the second concave housing 31 making the cylindrical body 21 move again in the direction of the plug 18 and reaching the configuration illustrated in FIG. 5.

In this configuration both the first pump 8 and the second pump 9 send their flows of oil to the user devices "PR1", "PR2" and "EF" because as the cylindrical body 21 moves, the fourth hole 17 closes and the connection between the first groove 25 and the latter, and therefore to the discharge way "S2", is interrupted.

From this configuration on, the cylindrical body 21, moving, starts feeding the first user device "PR1", the second user device "PR2" and the third user device "EF" according to a predetermined priority.

Figure 4:
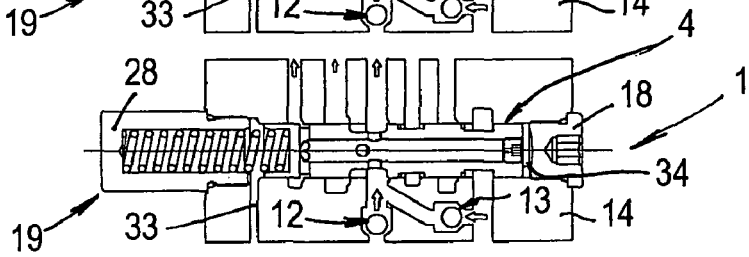
FIG. 4 is the longitudinal section view of FIG. 3 where two of the three user devices are fed with pressurised oil supplied at full rate by the first and second pump and a third user device starts receiving a small flow of pressurised oil.

In fact, if the flow of both the first pump 8 and the second pump 9 is still not enough to feed all the user devices "PR1", "PR2" and "EF", the action of the "load-sensing" signal continues on the second concave housing 31 and the cylindrical body 21 further moves once more in the direction of the plug 18, as illustrated in FIG. 4: the third groove 27 starts closing the sixth hole 7 by way of which the pressurised oil reaches the third user device "EF".

Figure 3:
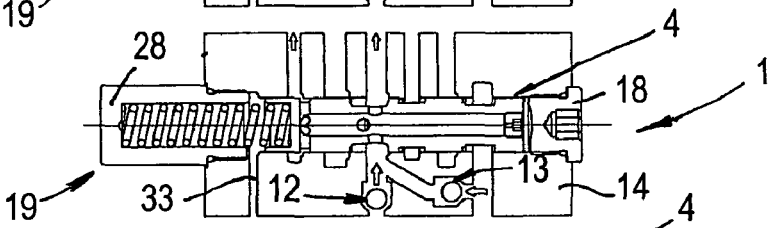
FIG. 3 is the longitudinal section view of FIG. 2 where two of the three user devices are fed with pressurised oil supplied at full rate by the first and second pump.

If this is still not enough, the cylindrical body 21 continues moving in the direction of the plug 18, reaching the configuration illustrated in FIG. 3.

In this configuration, the sixth hole 7 is completely closed and the third user device "EF" is no longer fed; therefore, the whole flow of the first pump 8 and of the second pump 9 is sent only to the second user device "PR2" and the first user device "PR1", having priority over the third user device "EF".

Figure 2:
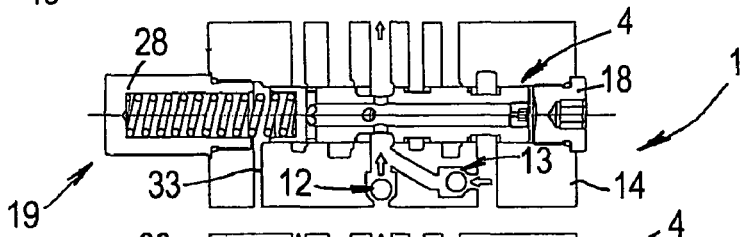
FIG. 2 is the longitudinal section view of FIG. 1 where one user device is fed with pressurised oil supplied at full rate by the first and second pump and a second user device is fed with a partial rate.

If the flow continues to be insufficient to feed both the first user device "PR1" and the second user device "PR2" and the latter require an additional flow of pressurised oil, the cylindrical body 21, still due to the combined action of the spring 30 and the "load-sensing" signal that acts on the second concave housing 31, continues moving towards the plug 18, gradually reaching the configuration illustrated in FIG. 2.

In this configuration, the first crosswise openings 23 of the cylindrical body 21 start becoming misaligned with respect to the fifth hole 6 which they close gradually.

Consequently, the flows of the first pump 8 and of the second pump 9 mainly reach the first user device "PR1", giving it priority in the supply of oil, while a limited flow reaches the second user device "PR2".

With the request for oil continuing by the first user device "PR1" which, consequently, has priority over the second user device "PR2", the cylindrical body 21 continues moving towards the plug 18, reaching the configuration illustrated in FIG. 1 where the connection between the first crosswise openings 23 and the fifth hole 6 is completely closed and the flows of pressurised oil supplied both by the first pump 8 and the second pump 9 are sent to the first user device "PR1" only.

The fourth valve apparatus 41 is calibrated so as to connect the first hole 5 and the tank 39 together when the pressure inside the first hole 5 reaches values that are too high, for example, caused by an anomalous interruption in sliding of the cylindrical body 21, to avoid damaging the first pump 8 or the second pump 9.

In the second version of the dynamic fluid device 1, the movements of the cylindrical body 21 in the direction of the plug 18 place the radial opening 37 and the seventh hole 38 in progressive mutual connection so the third valve apparatus 40 reach the pressure value.

When this pressure value reaches and exceeds a predetermined opening limit value of the third valve apparatus 40, it opens and places the storage tank 39 in connection with the first housing 29, discharging the pressure in it and causing the cylindrical body 21 to move in the direction of the contrast member 19 to such an extent that the connection opens between the second pump 9 and the discharge way "S2", through the first groove 25 which is across the second hole 11 and the fourth hole 17.

As happens for the first hole 38, if the pressure inside the first hole 5 reaches a predefined limit value coinciding with the opening value of the third valve apparatus 41, it will open and place the first hole 5 in connection with the storage tank 39, discharging the pressure into it until the closing value is reached for the third valve apparatus 41.

At one end the fifth valve apparatus 42 receive the thrust produced by an elastic element 45 that has a pre-selected load, and by the same "LS1" pressure signal which is detected inside the first user device "PR1", through a corresponding derived line 43.

Likewise, the fifth valve apparatus 42, at the opposite end, receive the same thrust produced by the pressure of the oil that flows towards the first user device "PR1", through a second derived line 44.

When the pressure of the oil flowing towards the first user device "PR1" reaches an excessively high value, such to exceed the thrust produced jointly by the elastic element 45 and the load-sensing signal "LS1", the fifth valve apparatus 42 positions itself in the oil passage closed configuration, thus protecting the first user device "PR1" from possible damage caused by an excessively high pressure value.

The invention claimed is:

1. Dynamic fluid device comprising:

a first pumping arrangement and a second pumping arrangement arranged in parallel with each other to pump a pressurized fluid to user devices;

a distributor member interposed amongst said first pumping arrangement, said second pumping arrangement and said user devices and connected to them with connection arrangements, wherein said distributor member is arranged to connect at least one of said first pumping arrangement and said second pumping arrangement to said user devices;

wherein said distributor member comprises:

a body element in which a sliding chamber is obtained, said body element being fitted with connection holes to connect with said user devices, with said first pumping arrangement, with said second pumping arrangement, and with discharge means;

a distributor element slidingly accommodated in said sliding chamber and adapted, through said sliding, to open and shut said connection holes;

a contrast member for contrasting said sliding of the distributor element;

wherein said connection holes comprise:

a first annular-shaped connection hole between said sliding chamber and said first pumping arrangement, a second annular-shaped connection hole between said sliding chamber and said second pumping arrangement, a third annular-shaped connection hole between said sliding chamber and said discharge means, a fourth annular-shaped connection hole between said sliding chamber and said discharge means, a fifth connection hole between said sliding chamber and a user device of said user devices, and a sixth connection hole between said sliding chamber and another user device of said user devices and wherein said distributor element comprises a cylindrical body provided with at least three perimeter grooves obtained in succession on an outer surface of said cylindrical body, a first groove being provided to connect, by means of said sliding, said second connection hole and said fourth connection hole together, a second groove being provided to connect, by means of said sliding, said first connection hole and said third connection hole together, a third groove being provided to connect, by means of said sliding, said first hole and said sixth hole together.

2. Dynamic fluid device according to claim 1, wherein said first pumping arrangement and said second pumping arrangement comprise a first pump and a second pump respectively, both with a fixed flow rate.

3. Dynamic fluid device according to claim 2, wherein connection conduits are provided in said body element between said user devices and said sliding chamber and between said first pump, said second pump and said sliding chamber.

4. Dynamic fluid device according to claim 1 wherein said sliding chamber is cylindrically shaped and features a first end closed with a plug member and an opposing second end closed with said contrast member.

5. Dynamic fluid device according to claim 4 wherein said distributor element comprises a cylindrical body which contains an axial through conduit which has a third open end that faces said plug member and an opposing fourth end featuring first crosswise openings flowing into said sliding chamber, second crosswise openings flowing into said sliding chamber being provided between said first crosswise openings and said third open end.

6. Dynamic fluid device according to claim 1 wherein a further user device of said user devices is connected to said first pumping arrangement and second pumping arrangement.

7. Dynamic fluid device according to claim 5 wherein said second crosswise openings open into said third groove.

8. Dynamic fluid device according to claim 5 wherein said first crosswise openings are provided to connect, by means of said sliding of said cylindrical body, said through conduit with said sixth hole.

9. Dynamic fluid device according to claim 5 wherein said contrast member comprises: a plug element that can be screwed into said second end; a first housing created axially inside said plug element; an elastic contrast spring member housed in said first housing and contained between a bottom of the same and an opposing second concave housing obtained in said fourth end.

10. Dynamic fluid device according to claim 9 wherein said second concave housing is provided with connecting radial openings with a corresponding seventh hole made in said body element, said seventh hole being connected to a storage tank.

11. Dynamic fluid device according to claim 1 wherein between said sliding chamber and said user devices is provided a detecting pipe to detect pressure in said user devices, by means of a signal flowing near to said second end of said sliding chamber through a connecting conduit.

12. Dynamic fluid device according to claim 1 wherein said first pumping arrangement and said second pumping arrangement comprise a first pump and a second pump respectively, at least one of which is of the fixed flow rate type and the other of the variable flow rate type.

* * * * *